United States Patent [19]

Pozzobon et al.

[11] Patent Number: 4,870,723

[45] Date of Patent: Oct. 3, 1989

[54] MULTIPLE-FUNCTION OPERATING DEVICE PARTICULARLY FOR SKI BOOTS

[75] Inventors: Alessandre Pozzobon, Paderno Di Ponzano Veneto; Roberto Gorza, Pedavena, both of Italy

[73] Assignee: Nordica S.p.A., Montebelluna TV, Italy

[21] Appl. No.: 274,692

[22] Filed: Nov. 14, 1988

Related U.S. Application Data

[63] Continuation of Ser. No. 946,240, Dec. 24, 1986, abandoned.

[30] Foreign Application Priority Data

Jan. 13, 1986 [IT] Italy ..... 19064 A/86

[51] Int. Cl.[4] ..... A43C 11/00

[52] U.S. Cl. ..... 24/68 SK; 36/50; 36/119

[58] Field of Search ..... 254/306, 310, 320, 321; 242/107.6; 36/119, 50; 24/68 R, 68 SK, 68 B, 71–72

[56] References Cited

U.S. PATENT DOCUMENTS 371,520 10/1887 Rowan ..... 254/310 X
522,064 6/1894 Keuffel ..... 242/107.6
695,067 3/1902 Mallon ..... 254/321 X
941,898 11/1909 Van Riper ..... 24/68 R
1,543,846 6/1925 Hansen ..... 254/306 X
3,664,599 5/1972 Partridge ..... 242/107.6 X
4,631,839 12/1986 Bonetti et al. ..... 24/68 SK X
4,633,599 1/1987 Morell et al. ..... 24/68 SK X

FOREIGN PATENT DOCUMENTS 525207 9/1921 France ..... 254/320

*Primary Examiner*—James R. Brittain
*Attorney, Agent, or Firm*—Guido Modiano; Albert Josif

[57] ABSTRACT

The multiple-function operating device comprises a containment body which is associatable with a ski boot and supports a lever which is accessible from the outside and is operatively connected, with the interposing of a ratchet-like assembly, with a central axle rotatably supported by said containment body. The peculiarity of the invention lies in that it comprises a selector which can be operated from the outside of the containment body and can be selectively coupled with a first and at least a second winding pulley, respectively of a first and a second cable and the like. Members are furthermore provided for removably locking the rotation of said pulleys in the direction of unwinding of the cables.

29 Claims, 2 Drawing Sheets

MULTIPLE-FUNCTION OPERATING DEVICE PARTICULARLY FOR SKI BOOTS

This is a continuation of Ser. No. 946,240, filed 12/24/86, now abandoned.

BACKGROUND OF THE INVENTION

The present invention relates to a multiple-function operating device particularly for ski boots.

As is known, operating devices are already currently employed in ski boots, which are assigned to, e.g., the closing of the quarters, to the tightening of the foot presser, or to other functions normally required in a boot, which are substantially composed of a ratchet-lever which acts on a winding pulley for a cable or a band which performs the required actuation. This arrangement has the advantage of allowing the actuation, i.e. the winding of the cable or of the band on the pulley, with subsequent partial rotations.

In the case in which in the same boot it is necessary to perform a plurality of actuations, such as e.g. the closing of the boot and the actuation of the foot instep presser, a single actuation device must be necessarily applied for each function, with obvious problems both regarding the accommodation of the same devices on the boot and regarding the structural complexity.

Another disadvantage of the solution of the prior art furthermore lies in that the presence of more than one separate actuation device causes severe limitations during the design of the shape of the boot, since it is necessary to take into account the spaces required for the accommodation of the same devices.

A further disadvantage which can be ascribed to the solution of the prior art is constituted by the fact that by arranging the various actuation devices in different regions, the user may have trouble in operating one device or the other, since a device may necessarily have to be positioned in a region which is poorly accessible by the user.

SUMMARY OF THE INVENTION

The air proposed by the invention is indeed to eliminate the above described disadvantages by providing a multiple-function operating device, specifically designed for ski boots, which allows the possibility of centralizing in a single region of the boot all the actuations required to close the boot or to secure the foot, thus allowing to perform with a single device all the required actuations.

Within the scope of the above described aim, a particular object of the invention is to provide a device which, by accommodating in a single zone all of the control elements, allows one to have wide margins of freedom in designing the shape and the aesthetics of the same boot.

Still another object of the present invention is to provide a device which, by centralizing more than one function, can be positioned in a region or point of the boot which is easy to reach, thus always allowing the user a comfortable position during actuation.

Not least object of the present invention is to provide an actuation device which, though assigned to a plurality of functions, allows the possibility of performing all the required actuations individually and indipendently from each other.

Not least object of the present invention is to provide a multiple-function actuation device which, by virtue of its peculiar structural characteristics, is capable of giving the greatest assurances of reliability and safety in use.

This aim and the objects described, as well as others which will become apparent hereinafter, are achieved by a multiple-function operating device particularly for ski boots, according to the invention, comprising a containment body, associable with a ski boot and supporting a lever, accessible from the outside and operatively connected, with the interposition of a ratchet assembly, to a central axle rotatably supported by said containment body, characterized in that it comprises a selector, actuable from the outside of said containment body and selectively couplable with a first and at leaast a second winding pulley, respectively of a first and at least a second cable and the like, there being furthermore provided means for removably locking the rotation of said pulleys in the direction of unwinding of the cables.

BRIEF DESCRIPTION OF THE DRAWINGS

Further characteristics and advantages will become apparent from the description of a preferred, but not exclusive, embodiment of a multiple-function operating device, particularly for ski boots, illustrated by way of non-limitative example in the accompanying drawings, where.

DESCRIPTION OF THE PREFERRED EMBODIMENTS

Figure 1:
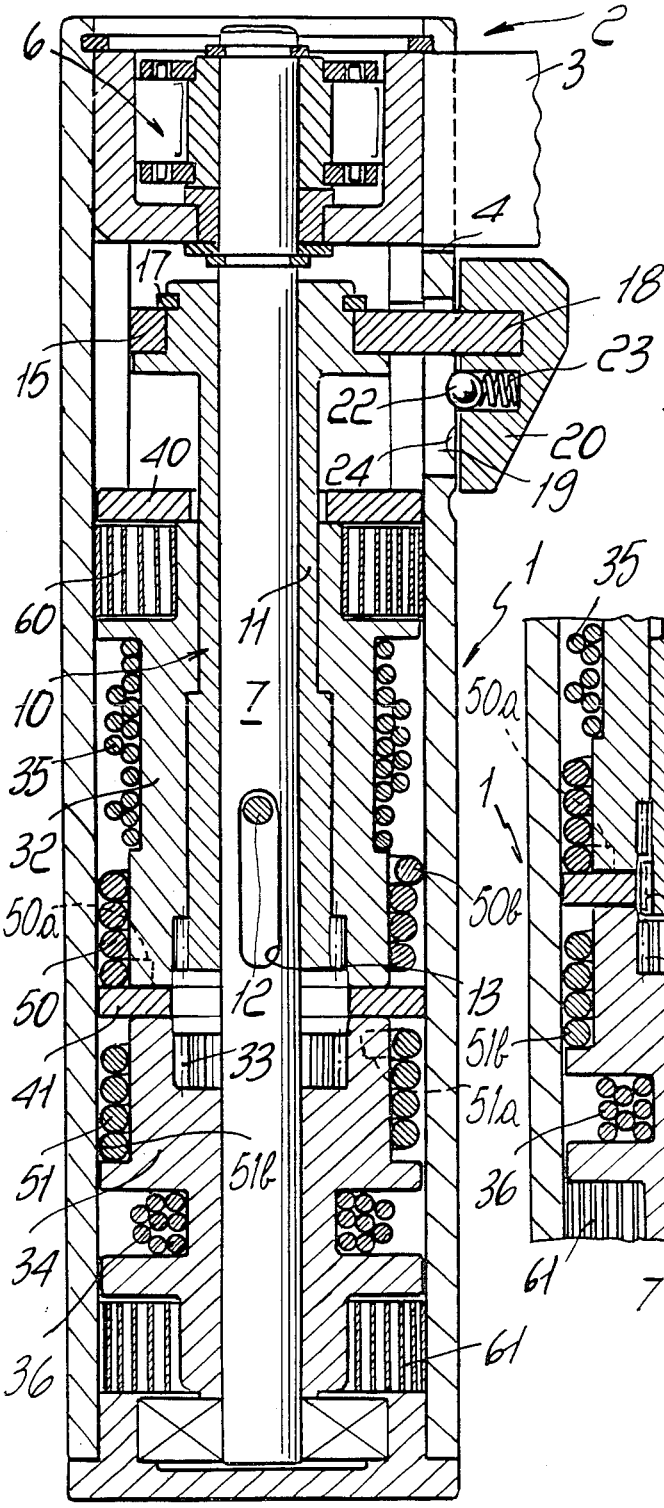
FIG. 1 is a longitudinal cross section view of the operating device, according to the invention, with the selector positioned to operate the first pulley.

With reference to the above described figures, the multiple-function operating device, particularly for ski boots, according to the invention, comprises a containment body, generally designated with the reference numeral 1, which preferably, but not necessarily, has a substantially cylindrical elongated shape.

Said containment body 1 is preferably, but not necessarily, supported on the rear portion of the rear quarter of a ski boot.

Proximate to its upper end, the containment body supports a lever, generally indicated by the reference numeral 2, which has an arm 3 protruding from the containment body 1 through a slit 4.

The lever 2 has a central body 5, which is coupled, with the interposition of a ratchet-like assembly or ratchet pawl, generally indicated by the reference numeral 6 and of a per se known kind, with a central axle 7, which is rotatably supported inside the containment body 1.

The ratchet-like assembly is intended to couple the lever 2 rigidly in rotation when operated in one direction, allowing instead the uncoupling of the rotation in the return phase of the lever, which return can be provided, in a per se known manner, by elastic means.

A selector engages with the central axle 7 slideably and rigidly in rotation, and is generally designated with the reference numeral 10, which has a bush-like body 11 accommodating in its interior the axle 7, which, by means of a key 12, slideably engages with a longitudinal slit 13 provided on the central axle 7, so as to have the selector 10 rigidly coupled in rotation with respect to the axle 7, but with the possibility of sliding in an axial direction.

The selector 10 is upwardly provided with a sliding ring 15, retained in position by means such as a Sieger ring 17; the sliding ring 15 is provided with a tab 18 which protrudes on the outside of the containment body 1 passing through a longitudinal opening 19 defined by the containment body 1.

A selector button 20 is connected to the tab 18, which button is provided, on the side facing the containment body 1, with a positioning ball 22 pushed by a spring 23 which is accommodatable in positioning recesses 24, defined on the outer surface of the containment body 1, so as to define preferential accommodation positions for the button 20 and consequently for the positioning of the selector inside said containment body 1.

Proximate to its lower end, the selector 10 is provided with a coupling gearwheel 30 which is selectively engageable with the gearwheel 31, correspondingly defined by a first pulley 32, and with the gearwheel 33, correspondingly defined by a second pulley 34. The gearwheels 31 and 33 are spaced apart from each other by an amount at least equal to the axial height of the teeth of the coupling gearwheel 30, so as to create an intermediate neutral or free position, as will be better described hereinafter.

The pulleys 32 and 34 perform the winding respectively of a first cable or the like 35 and of a second cable or the like 36, which are accommodated in respective slots 37 and 38 defined by the pulleys.

Said pulleys are selectively engageable in rotation with the axle 7 by means of the positioning of the selector, according to the coupling which is provided by the gearwheel 30 with the gearwheel 31 or 33.

The first pulley 32 is accommodated coaxially and externally to the selector 10 and is kept in position by means of an upper spacer 40, arranged inside the containment body 1 and an intermediate spacer 41 which axially separates the pulleys 32 and 34.

Figure 3:
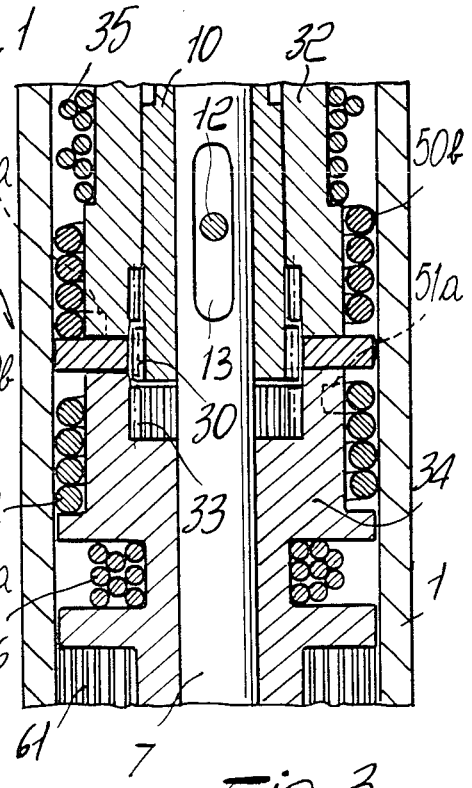
FIG. 3 is a cross section view of a detail of the device illustrating the selector in a neutral position disengaged from both pulleys.

On the first pulley 32 act first removable means for blocking the rotation of the pulley in the direction of unwinding, which advantageously are composed of a first pin-spring 50 having an end **50*a* fixed to the same pulley 32 and an other end 50*b* arranged in sliding contact engagement relationship with the internal surface 100 of the containment body 1, so that winding of the first cable 35 on the first pulley 37 causes the other end 50*b* of the first pin spring 50 to merely slide along the internal surface 100 of the containment body 1. However, rotation of the pulley 37 in a direction to effect unwinding of the first cable 35 from the first pulley 37, causes the end 50*b* of the pin spring 50 to frictionally engage with the internal surface 100 of the containment body 1. In this condition, since the end 50*a* of the pin spring 50 is fixed to the pulley 32 and the other end 50*b* of the pin spring is engaged with the internal surface of the containment body 1, rotation of the pulley 32 in the unwinding direction of the cable also causes the spring 50 itself to uncoil from the pulley 32, and thus rotation of the pulley 37 becomes blocked by the resulting radial expansion of the first pin spring 50, which engages with the internal surface of the containment body, throughout its circumference. (See FIGS. 1, 2 and 3). A button is furthermore provided, which is accessible from the outside and is not illustrated in the drawings, which permits release of the pin-spring 50** allowing, when required, the rotation of the pulley in the direction of unwinding of the cable.

Similarly, on the second pulley 34 second blocking means are provided, composed of a second pin-spring 51 having an end **51*a* fixed to the same pulley and another end 51*b* acting on the internal surface of the containment body 1; also in this case, a button is provided, which is accessible from the outside and is not illustrated in the drawings, for releasing the blocking action exerted by the second pin-spring 51, if the unwinding of the second cable 36** is desired.

On the first pulley 32 act furthermore first automatic cable rewinding means which are composed of a first spiral spring 60 connected between the pulley 32 and the internal wall of the containment body 1, which in practice is elastically loaded by the unwinding of the cable and is therefore capable of automatically recovering the initial part of the cable, until the biasing action exerted by the cable itself balances the spring. The subsequent cable locking action is performed by acting on the lever 2.

Similarly, second automatic rewinding means for the second cable are provided, which are composed of a second spiral spring 61 connected to the second pulley 34 and to the internal wall of the containment body 1, and acting similarly to what has been previously described.

The device is furthermore completed by anti-friction means which act on the pulleys and support the axle so as to reduce the forces.

In practical operation, the above described operating device allows the centralization of all of the required actuations, since it is possible, by virtue of the selector 10, to select the cable on which the traction is to be exerted.

Figure 2:
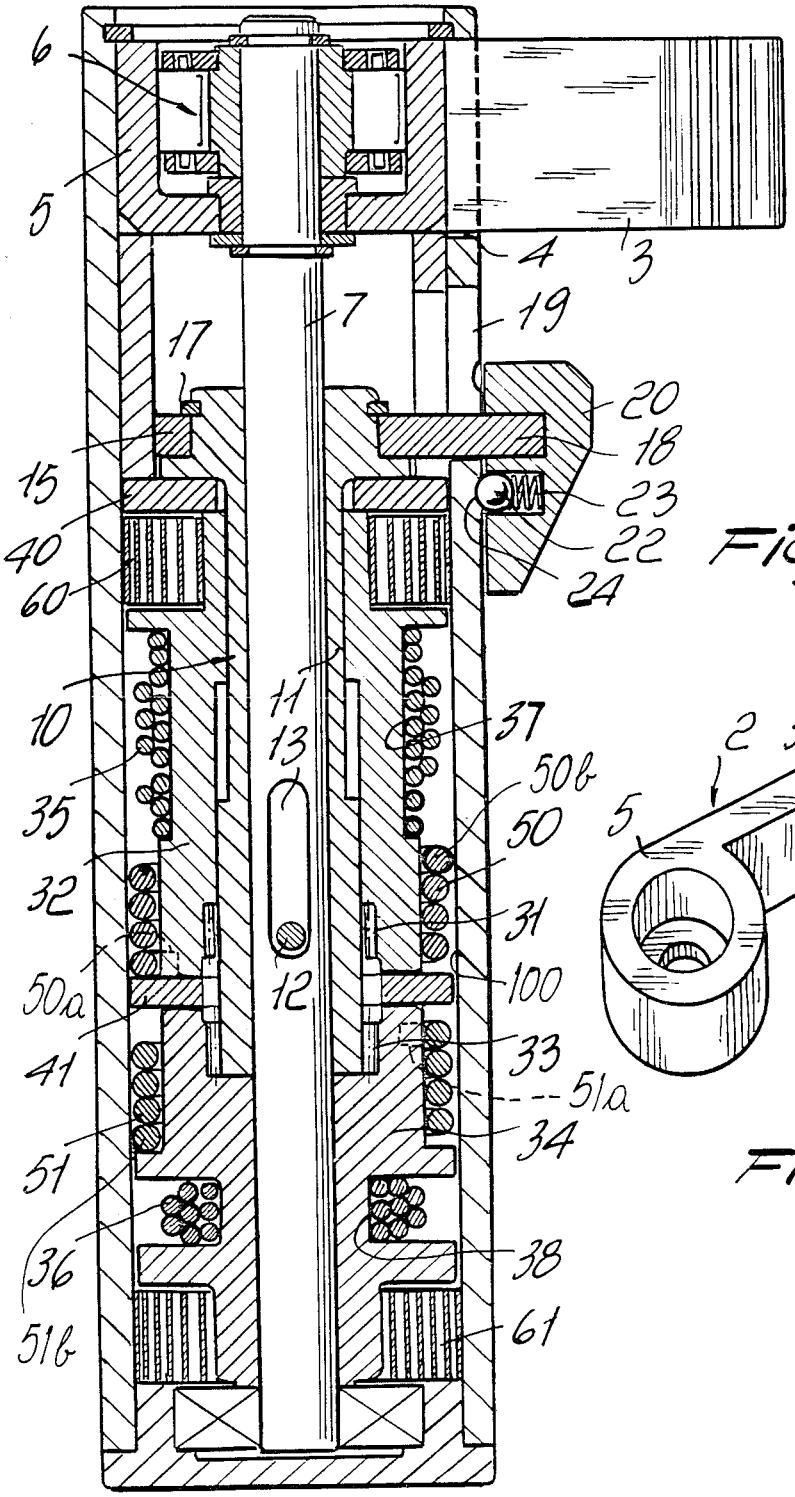
FIG. 2 is a cross section view of the operating device, with the selector positioned to operate the second pulley.
Figure 4:
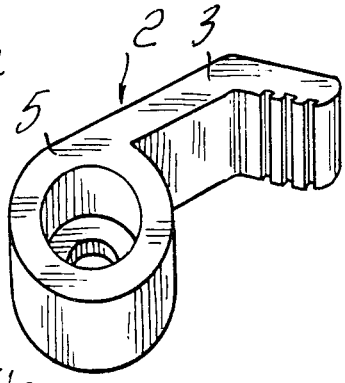
FIG. 4 is a schematic perspective view of the lever.

As illustrated in FIG. 1, the selector, by means of the selection button 20, is arranged in its lower position with the coupling gearwheel 30 coupled with the gearwheel 31 of the first pulley 32, so that the rotation generated on the axle 7 by means of the lever 2, causes the rotation in the direction of winding of the first pulley 32, with the consequent recovery of the cable or band 35, which is e.g. assigned to closing the quarters.

Once the required tightening action has been performed, it is sufficient to move the selector 10, by means of the selection button 20, causing the coupling gearwheel 30 to engage with the gearwheel 33 of the second pulley 34.

By repeating the alternate oscillation action of the lever 2, in this case the second pulley is made to rotate, and consequently the second cable or band, which is, e.g., connected to the foot instep presser, is wound.

When the pulleys are not coupled with the gearwheel, the rotation in the direction of unwinding is prevented by the removable blocking means composed of the pin-springs 50 and 51 which therefore maintain traction on the cable.

To perform the releasing and therefore allow the rotation of the pulleys in the direction of unwinding of the cable, it is sufficient to position the selector in the free position with the coupling gearwheel 30 not engaging any of the gearwheels of the pulleys 32 and 34, and then act on the release buttons of the pin-springs 50 and 51 to allow the unwinding of the cables.

It should also be noted that during the rotation of the pulleys in the direction of unwinding of the cables the spiral springs 60 and 61 of the automatic rewinding means are loaded, so that at the subsequent actuation a significant part of the length of the cable is automatically recovered by the rotation of the axle performed by virtue of the elastic recovery of the spiral springs 60 and 61.

From what has been described, it can be seen that the invention achieves the proposed aim, and in particular the fact is stressed that a device is provided which allows centralization of all of the actuations in a point which is convenient for the user, allowing him the possibility, by simply acting on the selection button 20, to perform each of the selected actuations, independently from one another when required.

Furthermore, another important feature of the invention is constituted by the fact that means for the elastic recovery of the initial portion of the length of the cable are provided, consequently expediting all the required actuations.

The invention thus conceived is susceptible of numerous modifications and variations, all of which are within the scope of the inventive concept.

Furthermore, all the details can be replaced by other technically equivalent elements.

Practically, the materials employed, so long as compatible with the specific use, as well as the dimensions and contingent shapes, may be any according to the requirements.

We claim:

1. Multiple function operating device for ski boots comprising a containment body, at least one actuating member, at least one axle, at least one selector, winding pulleys including at least one first winding pulley, and at least one second winding pulley, brake means for braking said first winding pulley and said second winding pulley, at least one first cable and at least one second cable, said first winding pulley, said second winding pulley and said selector being rotatably mounted in said containment body, said first winding pulley being adapted for winding said first cable, said second winding pulley being adapted for winding said second cable, said selector being rotatable in a cable winding direction and in a cable unwinding direction and having means for providing a temporary coupling engagement relationship with said first winding pulley and for disengagement from said first winding pulley for assuming a temporary coupling engagement relationship with said second winding pulley for consecutively winding said first cable and said second cable, said actuating member and said selector being mounted on said axle, at least one of said winding pulleys being mounted on said selector, said selector comprising a bush radially disposed between said axle and said first winding pulley and being connected to said axle so as to rotate with said axle.

2. Multiple function operating device according to claim 1, further comprising at least one ratchet assembly, said ratchet assembly being interposed between said actuating member and said selector, said actuating member being adapted for movement with respect to said containment body, said ratchet assembly being adapted for converting said movement of said actuating member into rotation of said selector in as least said cable winding direction.

3. A multiple function operating device according to claim 1, wherein said brake means are adapted for at least temporarily preventing rotation of said first winding pulley and said second winding pulley in said cable unwinding direction, said device further comprising at least one selector element, said selector element being operable for moving said selector relatively to said first winding pulley and said second winding pulley between at least a first position whereat said selector engages said first winding pulley and a second position whereat said selector engages said second winding pulley.

4. Multiple function operating device for ski boots comprising a containment body, at least one lever, at least one ratchet assembly, at least one selector, a plurality of winding pulleys including at least one first winding pulley at least one second winding pulley, brake means for braking said winding pulleys, at least one first cable and at least one second cable, said first winding pulley, said second winding pulley and said selector being rotatably mounted in said containment body, said first winding pulley being adapted for winding said first cable, said second winding pulley being adapted for winding said second cable, said selector and said first winding pulley and said second winding pulley being rotatable in a cable winding direction and in a cable unwinding direction, said selector having means for providing a temporary coupling engagement relationship with said first winding pulley and said second winding pulley, said ratchet assembly being operatively connected to said selector, said lever being adapted for movement with respect to said containment body for actuating said ratchet assembly, said ratchet assembly being adapted for converting said movement of said lever into rotation of said selector in at least said cable winding direction, said brake means being adapted for at least temporarily preventing rotation of said first winding pulley and said second winding pulley in said cable unwinding direction, said device further comprising at least one selector element, said selector element being operable for moving said selector relatively to said first winding pulley and said second winding pulley between at least a first position whereat said selector engages said first winding pulley and a second position whereat said selector engages said second winding pulley, at least one of said plurality of winding pulleys being mounted on said selector.

5. A multiple function operating device according to claim 4, further comprising a central axle, said central axle being journalled in said containment body, said selector being rotatively rigidly associated with said central axle, and axially slidable thereon.

6. A multiple function operating device acording to claim 4, further comprising at least one selector coupling means, at least one first winding pulley coupling means and at least one second winding pulley coupling means, said first winding pulley coupling means being rigidly associated with said first winding pulley, said second winding pulley coupling means being rigidly associated with said second winding pulley, said selector coupling means being rigidly associated with said selector and adapted for temporary coupling engagement relationship with said first winding pulley coupling means, said selector coupling means being further adapted for temporary coupling engagement relationship with said second winding pulley coupling means.

7. A multiple function operating device according to claim 6, wherein said selector coupling means comprises at least one coupling gearwheel, wherein said first winding pulley coupling means comprises a first winding pulley gearwheel, and wherein said second winding pulley coupling means comprises a second winding pulley gearwheel.

8. A multiple function operating device according to claim 4, wherein said selector element is further operable for moving said selector relatively to said first winding pulley and said second winding pulley to at least one intermediate neutral position, said intermediate neutral position being located between said first position whereat said selector engages said first winding pulley and said second position whereat said selector engages said second winding pulley.

9. A multiple function operating device according to claim 4, wherein said brake means comprise at least one first pin spring having at least one first spring end and at least one other first spring end and at least one second pin spring having at least one second spring end and at least one other second spring end, said containment body having an internal surface, said first spring end being rigidly associated with said first winding pulley, said second spring end being rigidly associated with said second winding pulley, said other first spring end and said other second spring end engaging said internal surface of said containment body in sliding contact engagement relationship.

10. A multiple function operating device according to claim 4, further comprising at least one first spiral spring and at least one second spiral spring, and wherein said containment body has an internal surface, said first spiral spring having at least one first spiral spring end and at least one other first spiral spring end, said second spiral spring having at least one second spiral spring end and at least one other second spiral spring end, said first spiral spring end being rigidly associated with said first winding pulley, said second spiral spring end being rigidly associated with said second winding pulley, said other first spiral spring end and said other second spiral spring end being rigidly associated with said internal surface of said containment body for automatically rewinding at least a portion of said first and second cables when unwound from said first and second winding pulleys.

11. A multiple function operating device according to claim 4, further comprising an axle, and wherein said selector comprises at least one bush and at least one key member, said axle being journalled in said containment body and having formed therein at least one slit, said key member being rigidly associated with said bush and extending through said slit, thereby rotatively rigidly associating said bush with said axle and permitting axial sliding movement of said bush on said axle.

12. A multiple function operating device according to claim 4, further comprising an axle said axle being journalled in said containment body, said first winding pulley being rotatably mounted on said selector, and said second winding pulley being rotatably mounted on said axle.

13. A multiple function operating device according to claim 4, wherein said containment body has formed therein at least one longitudinal opening, and wherein said selector element comprises at least one selector button, at least one tab, and button positioning means, said tab having at least one tab end, at least one other tab end, and at least one intermediate portion, said at least one tab end being rigidly associated with said selector, said intermediate portion of said tab extending through said longitudinal opening, said other tab end being rigidly associated with said selector button, said selector button being activatable for moving said tab along said longitudinal opening for causing movement of said selector relatively to said first winding pulley and said second winding pulley between said first position whereat said selector engages said first winding pulley and said second position whereat said selector engages said second winding pulley.

14. A multiple function operating device according to claim 13, wherein said containment body has an outer surface having formed therein a recesses, and wherein said selector button has a side facing said outer surface of said containment body, at least one spring and at least one ball, said side of said selector button facing said outer surface of said containment body and being adapted for accommodating said spring and for at least partially accommodating said ball, said spring being adapted for pushing said ball towards said outer surface of said copntainment body, said ball being adapted to be selctively partially accommodated in one of said recesses for defining a preferential accommodation position of said selector button.

15. A multiple function operating device according to claim 4, wherein said first winding pulley is mounted externally on said selector, said device further comprising at least one upper spacer element and at least one intermediate spacer element, said first winding pulley being mounted on said selector at an axial position, said upper spacer element and said intermediate spacer element being adapted for maintaining said first winding pulley at said axial position on said selector.

16. A multiple function operating device according to claim 15, wherein said upper spacer element is arranged inside said containment body.

17. A multiple function operating device according to claim 15, wherein said intermediate spacer element axially separates said first winding pulley and said second winding pulley.

18. Multiple function operating device for ski boots comprising a containment body, at least one lever, at least one ratchet assembly, at least one central axle, at least one selector, at least one first winding pulley, at least one second winding pulley, brake means, at least one first cable at least one second cable, at least one selector coupling means, at least one first winding pulley coupling means and at least one second winding pulley coupling means, said central axle, said first winding pulley and said second winding pulley being rotatably mounted in said containment body, said first winding pulley coupling means being rigidly associated with said first winding pulley, said first winding pulley being adapted for winding said first cable, said second winding pulley coupling means being rigidly associated with said second winding pulley, said second winding pulley being adapted for winding said second cable, said selector being associated with said central axle, said central axle and said first winding pulley and said second winding pulley being rotatable with respect to said containment body in a cable winding direction and in a cable unwinding direction, said selector coupling means being rigidly associated with said selector and having means for providing a temporary coupling engagement relationship with said first winding pulley coupling means, said selector coupling means further having means for providing a temporary coupling engagement relationship with said second winding pulley coupling means, said ratchet assembly being operatively associated with said central axle, said lever being oscillatable about said central axle, said ratchet assembly being interposed between said central axle and said lever adapted for converting oscillation of said lever into rotation of said central axle in said cable winding direction, said brake means being adapted for at least temporarily preventing rotation of at least one of said first winding pulley and said second winding pulley in said cable unwinding direction, said device further comprising at least one selector element, said selector element being connected to said selector and accessable externally of said containment body for moving said selector between at least a first position whereat said selector coupling means engages said first winding pulley coupling means and a second position whereat said selector coupling means engages said second winding pulley coupling means, said multiple function operating device further comprising means for connecting said selector to said axle so that said selector and said axle rotate together.

19. A multiple function operating device according to claim 18, wherein said selector coupling means comprises at least one coupling gearwheel, wherein said first winding pulley coupling means comprises a first winding pulley gearwheel, and wherein said second winding pulley coupling means comprises a second winding pulley gearwheel.

20. A multiple function operating device according to claim 18, wherein said selector element is further operable for moving said selector relatively to said first winding pulley and said second winding pulley to at least one intermediate neutral position, said intermediate neutral position being located between said first position whereat said selector engages said first winding pulley and said second position whereat said selector engages said second winding pulley.

21. A multiple function operating device according to claim 18, wherein said brake means comprise at least one first pin spring having at least one first spring end and at least one other first spring end and at least one second pin spring having at least one second spring end and at least one other second spring end, said containment body having an internal surface, said first spring end being rigidly associated with said first winding pulley, said second spring end being rigidly associated with said second winding pulley, said other first spring end and said other second spring end engaging said internal surface of said containment body in sliding contact engagement relationship.

22. A multiple function operating device according to claim 18, further comprising at least one first spiral spring and at least one second spiral spring, and wherein said containment body has an internal surface, said first sprial spring having at least one first spiral spring end and at least one other first spiral spring end, said second spiral spring having at least one second spiral spring end and at least one other second spiral spring end, said first spiral spring end being rigidly associated with said first winding pulley, said second spiral spring end being rigidly associated with said second winding pulley, said other first spiral spring end and said other second spiral spring end being rigidly associated with said internal surface of said containment body, for automatically rewinding at least a portion of said first and second cables when unwound from said first winding pulley and said second winding pulley.

23. A multiple function operating device according to claim 18, wherein said selector comprises at least one bush and at least one key member, said central axle being journalled in said containment body and having formed therein at least one slip, said key member being rigidly associated with said bush and extending through said slit, thereby rotatively rigidly associating said bush with said central axle, and permitting axial sliding movement of said bush on said central axle.

24. A multiple function operating device according to claim 18, wherein said first winding pulley is rotatably mounted on said selector, and wherein said second winding pulley is rotatably mounted on said central axle.

25. A multiple function operating device according to claim 18, wherein said containment body has formed therein at least one longitudinal opening, and wherein said selector element comprises at least one selector button, at least one tab, and button positioning means, said tab having at least one tab end, at least one other tab end, and at least one intermediate portion, said at least one tab end being rigidly associated with said selector, said intermediate portion of said tab extending through said longitudinal opening, said other tab end being rigidly associated with said selector button, said button being activatable for moving said tab along said longitudinal opening for causing movement of said selector relatively to said first winding pulley and said second winding pulley between said first position whereat said selector engages said first winding pulley and said second position whereat said selector engages said second winding pulley.

26. A multiple function operating device according to claim 25, wheein said containment body has outer surface having formed therein recesses, and wherein said selector button has a side facing said outer surface of said containment body, at least one spring and at least one ball, said side of said selector button facing said outer surface of said containment body being adapted for accommodating said spring and for at least partially accommodating said ball, said spring being adapted for pushing said ball towards said outer surface of said copntainment body, said ball being adapted to be selctively partially accommodated in one of said recesses for defining a preferential accommodation position of said selector button.

27. A multiple function operating device according to claim 18, wherein said first winding pulley is mounted externally on said selector, said device further comprising at least one upper spacer element and at least one intermediate spacer element, said first winding pulley being mounted on said selector an axial position, said upper spacer element and said intermediate spacer element being adapted for maintaining said first winding pulley at said axial position on said selector.

28. A multiple function operating device according to claim 27, wherein said upper spacer element is arranged inside said containment body.

29. A multiple function operating device according to claim 27, wherein said intermediate spacer element axially separates said first winding pulley and said second winding pulley.

* * * * *